US008368632B2

(12) United States Patent
Feng

(10) Patent No.: US 8,368,632 B2
(45) Date of Patent: Feb. 5, 2013

(54) DRIVING CIRCUIT FOR LIQUID CRYSTAL DISPLAY AND DRIVING METHOD THEREOF

(75) Inventor: Sha Feng, Shenzhen (CN)

(73) Assignees: Innocom Technology (Shenzhen) Co., Ltd., Shenzhen, Guangdong Province (CN); Chimei InnoLux Corporation, Miaoli County (TW)

( * ) Notice: Subject to any disclaimer, the term of this patent is extended or adjusted under 35 U.S.C. 154(b) by 954 days.

(21) Appl. No.: 12/386,619

(22) Filed: Apr. 20, 2009

(65) Prior Publication Data

US 2009/0262060 A1 Oct. 22, 2009

(30) Foreign Application Priority Data

Apr. 18, 2008 (TW) ..... 97114232 A

(51) Int. Cl.
*G09G 3/36* (2006.01)

(52) U.S. Cl. ..... 345/99; 345/690

(58) Field of Classification Search ..... 345/87, 345/89, 204, 581, 690, 99
See application file for complete search history.

(56) References Cited

U.S. PATENT DOCUMENTS 5,610,626 A 3/1997 Kasai et al.
7,095,395 B2 8/2006 Bu
2002/0118183 A1* 8/2002 Inuzuka et al. ..... 345/204
2002/0130881 A1* 9/2002 Kudo et al. ..... 345/581
2003/0184508 A1* 10/2003 Lee ..... 345/87
2005/0195144 A1* 9/2005 Kwon et al. ..... 345/89
2006/0103682 A1* 5/2006 Kunimori et al. ..... 345/690

FOREIGN PATENT DOCUMENTS

CN 1703650 A 11/2005

* cited by examiner

*Primary Examiner* — Quan-Zhen Wang
*Assistant Examiner* — Calvin C Ma
(74) *Attorney, Agent, or Firm* — Li & Cai Intellectual Property (USA) Office

(57) ABSTRACT

An LCD driving circuit converts multiple data signals generated by an external circuit to a plurality of desired data signals. The driving circuit includes a detector detecting a current environmental temperature and outputting a corresponding electric signal, a timing controller receiving the data signals, and a look-up table storing a corresponding relationship among multiple electric signals corresponding to different environmental temperatures, the data signals and multiple of control signals driving the timing controller. The look-up table outputs a corresponding control signal according to the relationship stored therein to the timing controller. The timing controller processes the data signals using a frame rate algorithm under control of the corresponding control signal, thereby outputting the desired data signals to the data driving circuit.

15 Claims, 5 Drawing Sheets

26

| | | | |
|---|---|---|---|
| 000000~111110 | T1 | 00 | C0 |
| | | 01 | C1 |
| | | 10 | C2 |
| | | 11 | C3 |
| | T2 | 00 | C1 |
| | | 01 | C2 |
| | | 10 | C3 |
| | | 11 | C4 |
| | T3 | 00 | C2 |
| | | 01 | C3 |
| | | 10 | C4 |
| | | 11 | C5 |
| | ⋮ | ⋮ | ⋮ |
| | Tk | 00 | |
| | | 01 | |
| | | 10 | |
| | | 11 | Ci |
| 111111 | | | C0 |

FIG. 3

36

| | | | |
|---|---|---|---|
| 000000~111101 | T1 | 00 | ⋮ |
| | | 01 | |
| | | 10 | |
| | | 11 | |
| | T2 | 00 | |
| | | 01 | |
| | | 10 | |
| | | 11 | |
| | T3 | 00 | |
| | | 01 | Ci |
| | | 10 | |
| | | 11 | |
| | ⋮ | ⋮ | |
| | Tk | 00 | |
| | | 01 | |
| | | 10 | |
| | | 11 | |
| 111110 | | 00 | C0 |
| | | 01 | C1 |
| | | 10 | C2 |
| | | 11 | C3 |
| 111111 | | 00 | C4 |
| | | 01 | C5 |
| | | 10 | C6 |
| | | 11 | C7 |

FIG. 5

DRIVING CIRCUIT FOR LIQUID CRYSTAL DISPLAY AND DRIVING METHOD THEREOF

BACKGROUND

1. Technical Field

The present disclosure relates to a driving circuit of a liquid crystal display (LCD) and a driving method thereof, and more particularly to a driving circuit that has a gamma correction function and method thereof.

2. Description of Related Art

LCDs are widely used in the field of computers, televisions, and other devices.

The LCD includes a liquid crystal panel and a backlight module providing a planar light thereto. The liquid crystal panel includes a first substrate having a common electrode thereon, a second substrate on which a pixel electrode is arranged in a matrix array corresponding to pixels, and liquid crystal molecules sandwiched therebetween. During operation, a common voltage signal is applied to the common electrode and a gray-level voltage signal is applied to the pixel electrode, thereby changing polarities of the liquid crystal molecules in response to an electric field generated by the pixel electrode and the common electrode. Luminance of transmissive light emitted from the backlight module changes following the changes in polarity, such that light and dark are displayed. Color display is accomplished by arranging primary colors of red (R), green (G), and blue (B) on the first substrate and driving the pixel electrode in along a row or column orientation so that power corresponding to color is applied thereto.

Recently, LCD panels having an 8 or 12 millisecond response time widely use a 6-bit color display panel. Accordingly, $2^6=64$ gray levels of each color are represented, and as many as $(2^6)^8=262144$ colors can be generated by all of the R (red), G (green), and B (blue) colors. Further, if a frame rate control (FRC) algorithm is used to drive the 6-bit color liquid crystal panel, the panel has the same color display ability as an 8-bit color liquid crystal panel, being capable of displaying 16.7M colors.

Referring to FIG. 6, a typical FRC algorithm is shown. Each rectangle represents a pixel, with four pixels forming a pixel assembly. When each pixel of the pixel assembly displays a gray level n ($0 \leqq n \leqq 63$), the pixel assembly displays the gray level n. When each pixel of the pixel assembly displays a gray level (n+1), the pixel assembly displays the gray level (n+1). After using the FRC algorithm, three gray levels (n+1/4), (n+2/4) and (n+3/4) are inserted between the gray level n and the gray level (n+1). Thus, because the 6-bit color liquid crystal panel can naturally display 64 gray levels, the 6-bit color liquid crystal panel can display 252 gray levels using the FRC algorithm.

Referring to FIG. 7, a gamma curve at a definite temperature is shown, wherein the cross axis V denotes voltage values corresponding to every gray level, and the ordinate axis T denotes transmission ratio of the pixel. Generally, a standard gamma curve is set to drive the liquid crystal panel. However, because the transmission ratio changes with environmental temperature, the relationship between the voltage value and the transmission ratio is different from that defined by the standard gamma curve. Thus, color accuracy of the liquid crystal panel, restricted to the standard gamma curve, can suffer.

What is needed, therefore, is a driving method that can overcome the limitations described, and an LCD using the method.

BRIEF DESCRIPTION OF THE DRAWINGS

The components in the drawings are not necessarily drawn to scale, the emphasis instead being placed upon clearly illustrating the principles of at least one embodiment. In the drawings, like reference numerals designate corresponding parts throughout the various views.

FIG. 3 is a block diagram of the look-up table of FIG. 1.

FIG. 5 is a block diagram of a look-up table of a second embodiment of a driving circuit for an LCD according to the present disclosure.

DETAILED DESCRIPTION

Figure 1:
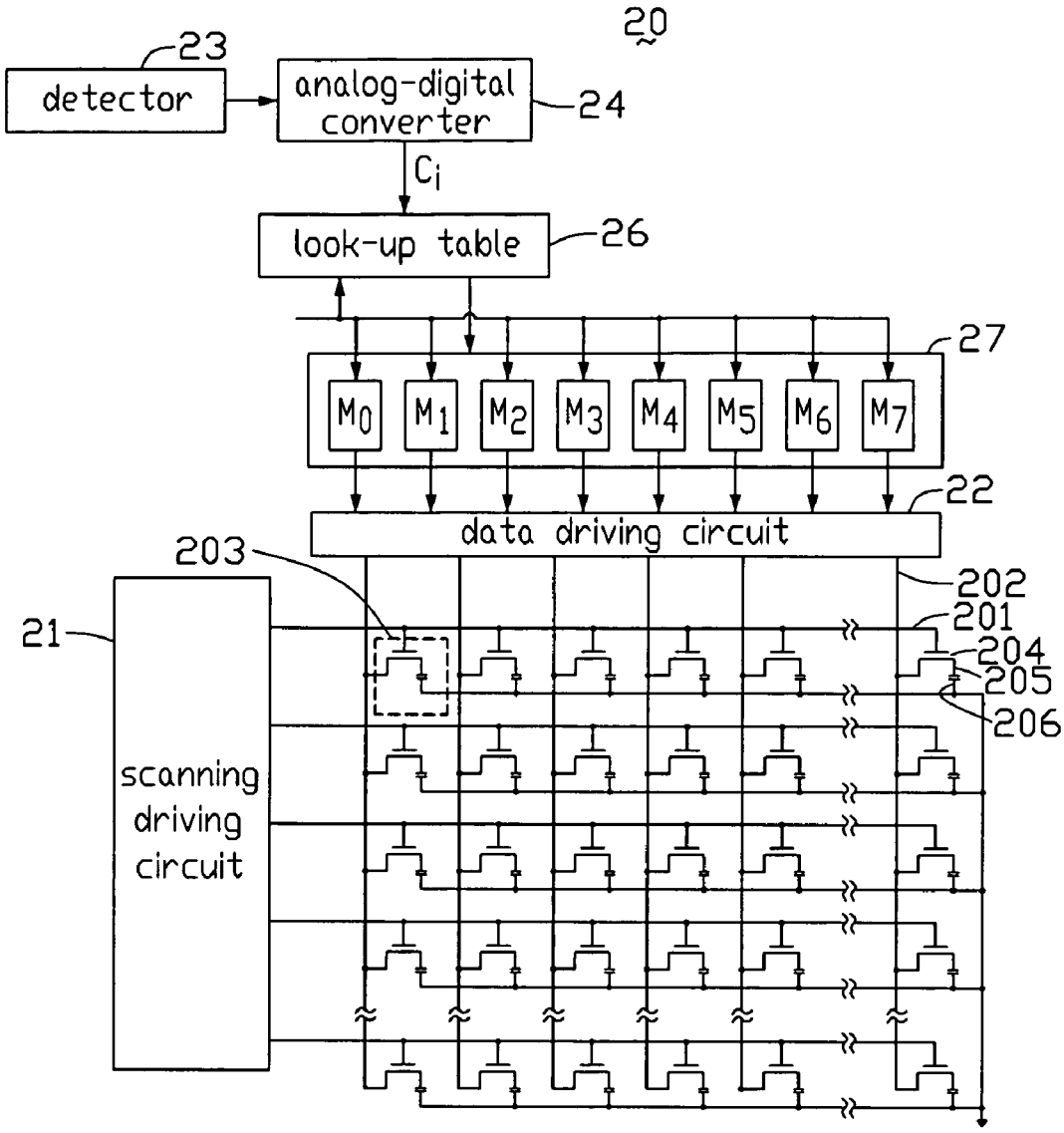
FIG. 1 is a circuit diagram of a first embodiment of a driving circuit for an LCD according to the present disclosure, the LCD including a liquid crystal panel, and the driving circuit including a look-up table.

FIG. 1 is a circuit diagram of a first embodiment of a driving circuit for an LCD according to the present disclosure, the driving circuit including a look-up table. The LCD further includes a liquid crystal panel (not shown) and a backlight module. The liquid crystal panel is a 6-bit color display panel, and includes a first substrate (not shown), a second substrate (not shown) facing the first substrate, and a liquid crystal layer (not shown) having a plurality of liquid crystal molecules disposed between the two substrates. The driving circuit 20 is configured to drive the liquid crystal panel.

The driving circuit 20 includes a plurality of scanning lines 201 parallel to each other, and each extending along a first axis, a plurality of data lines 202 parallel to each other, and each extending along a second axis orthogonal to the first, a scanning driving circuit 21, a data driving circuit 22, a detector 23, an analog-digital converter 24, a look-up table 26 and a timing controller 27. The look-up table 26 can be integrated into the timing controller 27.

The scanning lines 201 and the data lines 202 intersect, thereby defining a plurality of pixel units 203. Each pixel unit 203 includes a thin film transistor (TFT) 204 that functions as a switching element, a pixel electrode 205 and a common electrode 206 arranged opposite to the pixel electrode 205. A gate electrode (not labeled), a source electrode (not labeled) and a drain electrode (not labeled) of the TFT 204 are respectively connected to a corresponding scanning line 201, a corresponding data line 202 and a corresponding pixel electrode 205. The pixel electrode 205, the common electrode 206 and liquid crystal molecular sandwiched therebetween form a liquid crystal capacitor (not labeled).

The detector 23 detects a current environmental temperature, and converts the detected temperature signal to a corresponding analog electric signal. The analog-digital converter 24 converts the corresponding analog electric signal to a digital electric signal, and applies the digital electric signal to the look-up table 26.

The timing controller 27 receives a plurality of 8-bit binary data signals generated by an external circuit (not shown), and includes eight frame rate controller Mi (the number i is an integer from 0 to 7). The 8-bit binary data signals range from 00000000 to 11111111. The eight frame rate controllers M0~M7 simultaneously receive a common 8-bit binary data signal, and are respectively driven by corresponding control signals Ci generated from the look-up table 26. When the control signal ci is applied to a corresponding frame rate controller Mi, the 8-bit binary data signal is converted to a 6-bit binary data signal using an FRC algorithm, and is applied to the data driving circuit 22.

Figure 2:
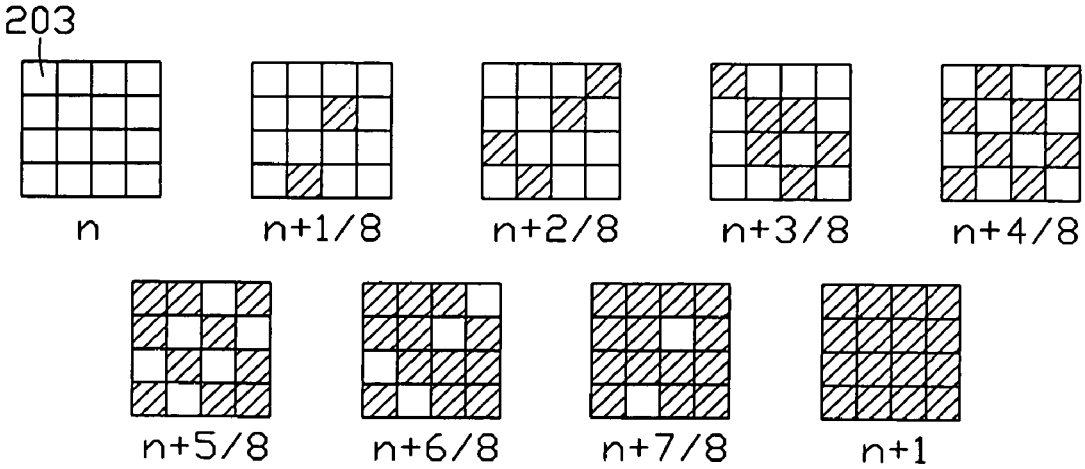
FIG. 2 illustrates a principle of an FRC algorithm employed by the driving circuit of FIG. 1.

Referring to FIG. 2, a principle diagram of the FRC algorithm used by the timing controller 27 is shown, each minimum rectangle denoting one pixel unit 203, and every sixteen pixel units 203 forming a pixel assembly. As viewed in FIG. 2, when each pixel unit 203 of the pixel assembly displays a gray level n, the pixel assembly displays the gray level n. When each pixel unit 203 of the pixel assembly displays a gray level (n+1), the pixel assembly displays the gray level (n+1). When the number n is an integer selected from 0 to 62, the nine pixel assemblies respectively display nine gray levels n, (n+1/8), (n+2/8), (n+3/8), (n+4/8), (n+5/8), (n+6/8), (n+7/8) and (n+1). For the liquid crystal panel of the first embodiment, when the number n is equal to 63, only gray level 63 is displayed by the liquid crystal panel.

Thus, according to the above FRC algorithm, when the gray level n is from 0 to 62, the eight frame rate controllers M0~M7 output corresponding 6-bit binary data signals that respectively represent the gray levels n, (n+1/8), (n+2/8), (n+3/8), (n+4/8), (n+5/8), (n+6/8), (n+7/8) and (n+1). When the gray level n is the gray level 63, only the frame rate controller M0 outputs the corresponding 6-bit binary data signal that represents the gray level 63.

Referring also to FIG. 3, the 8-bit binary data signals are simultaneously applied to the look-up table 26. The look-up table 26 represents a relationship among a plurality of digital electric signals T1, T2, T3, . . . Tk corresponding to environmental temperatures in which the liquid crystal panel usually works, the 8-bit binary data signals and the control signals Ci. The 8-bit binary data signals are divided into two parts stored in different columns of the look-up table 26. Higher 6 bits binary data of the 8-bit binary data signal denoting the corresponding gray level n form the first part. Two numerical ranges of the higher 6 bits binary data are respectively stored in different rows of a first column of the look-up table 26. One numerical range is from 000000 to 111110, the other range is 111111. Lower 2 bits binary data thereof including 00, 01, 10, 11 form a second part, and are configured to form four different selecting signals. The selecting signals 00, 01, 10, 11 are stored in a third column of the look-up table 26. The digital electric signals T1, T2, T3, . . . Tk are stored in a second column of the look-up table 26. Each digital electric signal Tk corresponds to a set of four selecting signals 00, 01, 10, and 11. The eight control signals C0~C7 are stored in a fourth column of the look-up table 26, and each selecting signal corresponds to one control signal Ci selected from the eight control signals C0~C7. Every datum stored in the look-up table 26 is optimized data to obtain good color performance. That is, for the same 8-bit binary data signal transmitted from the external circuit, the pixel units 203 can obtain the same transmission ratio in different environmental temperatures.

As viewed in FIG. 3, when the higher 6 bits binary data of one 8-bit binary data signal are 000000 to 111110 ($0 \leqq n \leqq 62$), the higher 6 bits binary data correspond to the digital electric signals T1, T2, T3, . . . Tk, and each digital electric signal Tk corresponds to the four selecting signals 00, 01, 10 and 11. Each of the four selecting signals 00, 01, 10, 11 corresponds to one control signal Ci, and the control signals Ci is configured to drive a corresponding frame rate controller Mi in order to display the gray level (n+i/8). For example, the four selecting signals 00, 01, 10 and 11 corresponding to the digital electric signal T1 respectively correspond to four control signals c0, c1, c2 and c3; the four selecting signals 00, 01, 10 and 11 corresponding to the digital electric signal T2 respectively correspond to four control signals c1, c2, c3 and c4; and the four selecting signals 00, 01, 10 and 11 corresponding to the digital electric signal T3 respectively correspond to four control signals c2, c3, c4 and c5. That is, different frame rate controllers Mi are driven in different environmental temperatures. The frame rate controllers Mi output corresponding 6-bit binary data signal that represents the corresponding gray level.

When the higher 6 bits binary datum of one 8-bit binary data signal is 111111 (n=63), the higher 6 bits binary datum merely corresponds to the control signal C0. Thus, the frame rate controller M0 is driven by the control signal C0, and the liquid crystal panel displays the gray level 63.

The data driving circuit 22 converts the 6-bit binary data signals to corresponding analog data signals, and output gray-level voltages corresponding to the analog data signals to the pixel electrodes 205 via the data lines.

Figure 4:
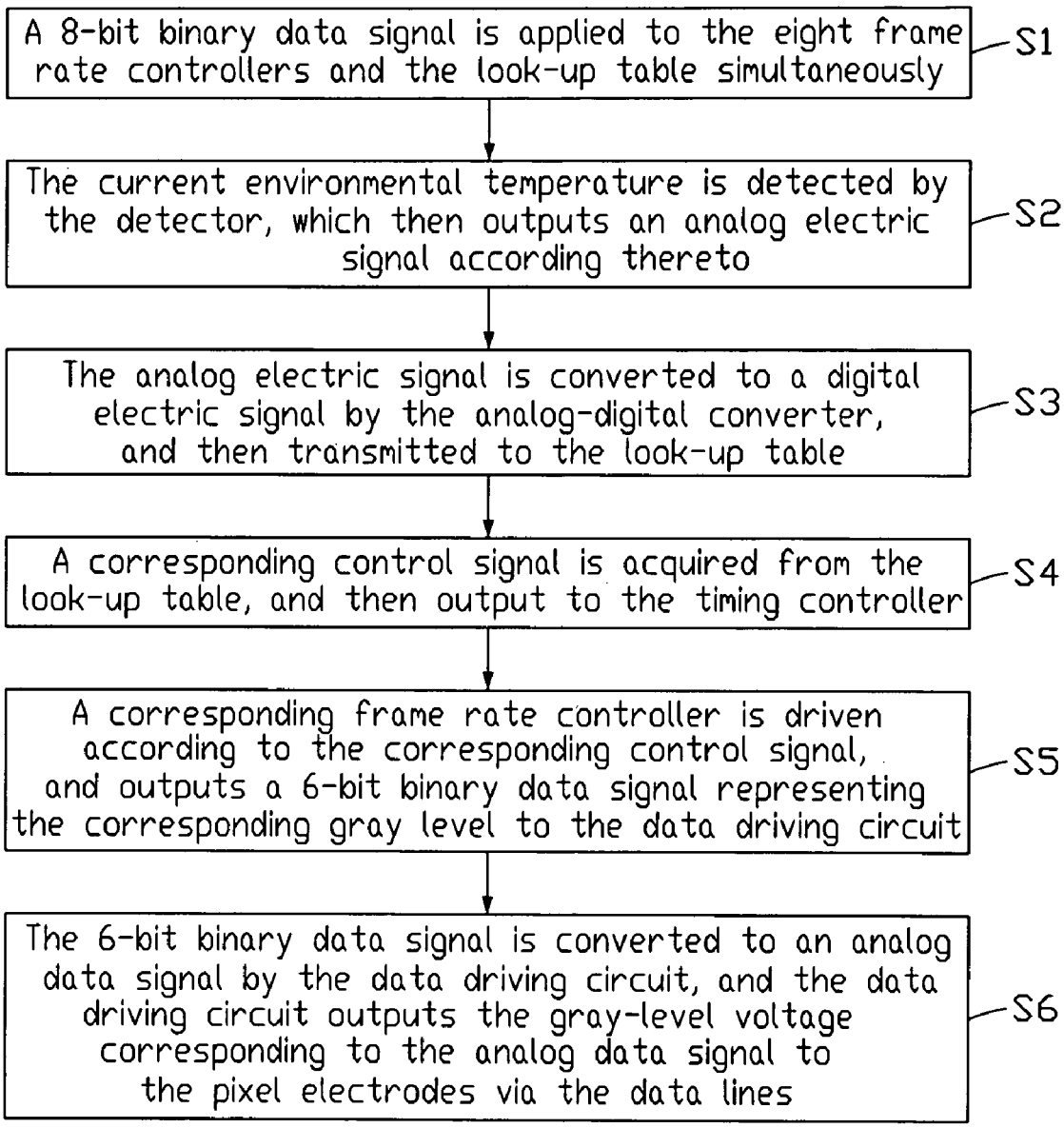
FIG. 4 is essentially an isometric view showing a step of a driving method for the liquid crystal panel of the LCD of FIG. 1.
Figure 6:
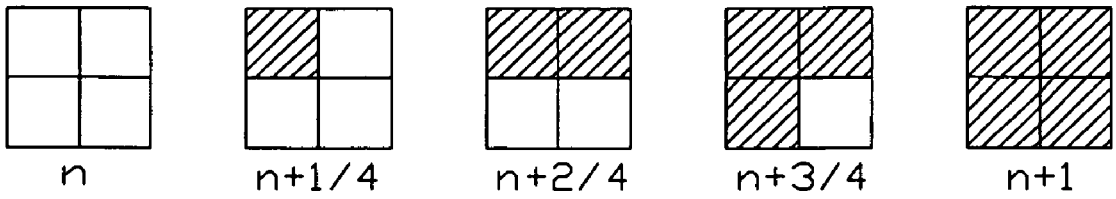
FIG. 6 (RELATED ART)
FIG. 6 illustrates a principle of a conventional FRC algorithm.
Figure 7:
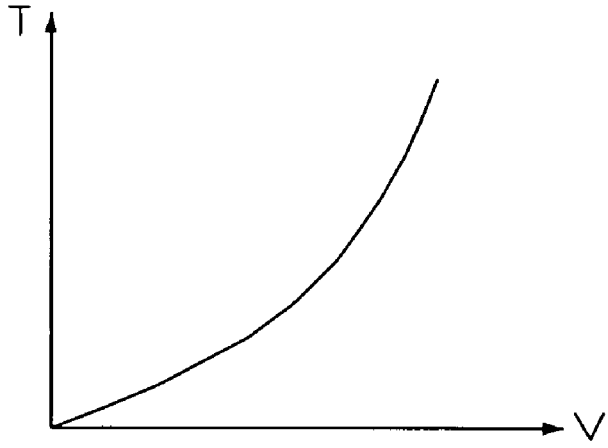
FIG. 7 (RELATED ART)
FIG. 7 is a diagram of a gamma curve at a definite temperature employed by a conventional liquid crystal panel.

Referring to FIG. 4, a driving method for the liquid crystal panel is also disclosed, as follows.

In step S1, a 8-bit binary data signal is applied to the eight frame rate controllers M0~M7 and the look-up table 26 simultaneously. Higher 6 bits binary datum of the 8-bit binary data signal represents the gray level n, and lower 2 bits binary datum thereof forms the selecting signal.

In step S2, the current environmental temperature is detected by the detector 23, which then outputs an analog electric signal according thereto.

In step S3, the analog electric signal is converted to a digital electric signal Tk by the analog-digital converter 24, and then transmitted to the look-up table 26.

In step S4, a corresponding control signal Ci is acquired from the look-up table 26, and then output to the timing controller 27. When the digital electric signal Tk is applied to the look-up table 26, a corresponding control signal Ci is acquired from the look-up table 26 according to the relationship among the digital electric signal Tk, the higher 6 bits binary datum and the lower 2 bits binary datum, and the corresponding control signal Ci is applied to the timing controller 27.

In step S5, a corresponding frame rate controller Mi is driven according to the corresponding control signal Ci, and outputs a 6-bit binary data signal representing the gray level (n+i/8) to the data driving circuit 22.

In step S6, the 6-bit binary data signal is converted to an analog data signal by the data driving circuit 22, and the data driving circuit 22 outputs the gray-level voltage corresponding to the analog data signal to the pixel electrodes 205 via the data lines 202.

Because the timing controller 27 can regulate the gray level voltages with the current environmental temperature, even if the same 8-bit binary data signal generated by the external circuit is applied to the liquid crystal panel in different environmental temperatures, the pixels 203 can obtain the same transmission ratio. Thus, color quality of the LCD is improved.

FIG. 5 is a block diagram of a look-up table of a second embodiment of a driving circuit for an LCD according to the present disclosure, differing from the first embodiment only in that a first column of the look-up table 36 stores three different numerical ranges of higher 6 bits binary data. A first numerical range from 000000 to 111101 corresponds to multiple digital electric signals T1~TK. Each digital electric signal Tk corresponds to four selecting signals 00, 01, 10 and 11. Each selecting signal corresponds to a control signal Ci (i=0, 1, 2 . . . 7). The eight control signals C0~C7 are configured to drive eight frame rate controllers Mi respectively. A second numerical range of 111110 merely corresponds to four selecting signals 00, 01, 10, and 11, and the four selecting signals 00, 01, 10, and 11 respectively correspond to control signals C0, C1, C2 and C3. The control signals C0, C1, C2, and C3 are configured to drive corresponding frame rate controllers M0~M3, thereby displaying 62, 62+1/8, 62+2/8 and 62+3/8 gray levels. A third numerical range of 111111 corresponds to four selecting signals 00, 01, 10 and 11, and the four selecting signals 00, 01, 10 and 11 respectively correspond to control signals C4, C5, C6 and C7. The control signals C4, C5, C6, and C7 are configured to drive corresponding frame rate controllers M4~M7, thereby displaying 62+4/8, 62+5/8, 62+6/8 and 62+7/8 gray levels.

When the 8-bit binary data signal applied to the LCD is 11111100 to 11111111, the LCD can display four gray levels. But when the 8-bit binary data signal applied to the LCD of the first embodiment is 11111100 to 11111111, the LCD merely displays one gray level. Thus, the number of gray levels displayed exceeds that of the gray levels displayed by the LCD of the first embodiment. That is, the LCD can display 256 gray levels.

In addition, the digital electric signals stored in the second column of the look-up table 26 or 36 represent different temperature value ranges, not a specific temperature value.

Furthermore, the relationship between the higher 6 bits binary data from 111110 to 111111 and the control signals Ci of the look-up table 36 can also be altered, so that the LCD can display eight gray levels when the 8-bit binary data signal is 11111000 to 11111111.

It is to be understood that even though numerous characteristics and advantages of the present embodiments have been set forth in the foregoing description with details of the structures and functions of the embodiments, the disclosure is illustrative only, and changes made in detail, especially in matters of shape, size, and arrangement of parts, within the principles of the embodiments, to the full extent indicated by the broad general meaning of the terms in which the appended claims are expressed.

What is claimed is:

1. A driving circuit of a liquid crystal display (LCD), the LCD comprising a liquid crystal panel driven by the driving circuit, the driving circuit receiving and converting a plurality of data signals generated by an external circuit to a plurality of desired data signals, the driving circuit comprising:

a data driving circuit;

a detector configured for detecting a current environmental temperature and outputting a corresponding electric signal;

a timing controller receiving the plurality of data signals and the timing controller comprising eight frame rate controllers, the eight frame rate controllers configured to output the desired data signals to the data driving circuit, wherein the data signals are 8-bit binary data signals and the desired data signals are 6-bit binary data signals; and a look-up table that stores a corresponding relationship among a plurality of electric signals corresponding to a plurality of environmental temperatures, the plurality of data signals, and a plurality of control signals that are configured for driving the timing controller; and wherein the look-up table receives the plurality of data signals and the corresponding electric signal, and outputs a corresponding control signal according to the relationship stored therein to the timing controller, and the timing controller processes the plurality of data signals using a frame rate algorithm under control of the corresponding control signal, thereby outputting the desired data signals to the data driving circuit; wherein when the higher 6 bits binary data of each data signal input to the timing controller is 111111, a specific frame rate controller selected from the eight frame rate controllers outputs the 6-bit binary data signal representing a gray level 63.

2. The driving circuit of claim 1, wherein when a higher 6 bits binary datum of each data signal input to the timing controller is from 000000 to 111110, the eight frame rate controllers respectively represent the gray levels n, (n+1/8), (n+2/8), (n+3/8), (n+4/8), (n+5/8), (n+6/8), (n+7/8) and (n+1), wherein the higher 6 bits binary datum determines a numerical value of the number n, and the number n is an integer selected from a range from 0 to 62.

3. The driving circuit of claim 1, wherein each of the 8-bit binary data signals is divided into two parts stored in different columns of the look-up table, the higher 6 bits binary data of the 8-bit binary data signals denoting the gray level form a first part, and the lower 2 bits binary data thereof denoting a selecting signal form a second part.

4. The driving circuit of claim 3, wherein two numerical ranges of the higher 6 bits binary data are respectively stored in two different rows of a same column of the look-up table, a first numerical range is from 000000 to 111110, and a second numerical range is 111111.

5. The driving circuit of claim 4, wherein the higher 6 bits binary data in the first numerical range corresponds to the plurality of electric signals corresponding to a plurality of environmental temperatures, each electric signal corresponds to four selecting signals, and each selecting signal corresponds to one of the control signals; and the higher 6 bits binary data in the second numerical range merely corresponds to a specific control signal configured for driving the specific frame rate controller.

6. The driving circuit of claim 1, wherein when a higher 6 bits binary datum of the data signal input to the timing controller is 111101, a first specific frame rate controller selected from the eight frame rate controllers outputs a corresponding 6-bit binary data signal; and when the higher 6 bits binary data of the data signal input to the timing controller is 111111, a second specific frame rate controller selected from the eight frame rate controllers outputs another corresponding 6-bit binary data signal.

7. The driving circuit of claim 6, wherein three numerical ranges of the higher 6 bits binary data corresponding to the plurality of data signals are respectively stored in three different rows of a same column of the look-up table, a first numerical range is from 000000 to 111101, a second numerical range is 111110, and a third numerical range is 111111.

8. The driving circuit of claim 7, wherein the higher 6 bits binary datum in the first numerical range corresponds to the plurality of electric signals that correspond to a plurality of environmental temperatures, each electric signal corresponds to four selecting signals, and each selecting signal corresponds to one of the control signals; the higher 6 bits binary datum in the second numerical range merely corresponds to the four selecting signals, and each selecting signal corresponds to a first specific control signal configured for driving the first specific frame rate controller; and the higher 6 bits binary data in the third numerical range merely corresponds to the four selecting signals, and each selecting signal corresponds to a second specific control signal configured for driving the second specific frame rate controller.

9. A driving method for an LCD, the LCD comprising a liquid crystal panel and a driving circuit providing a desired data signal to the liquid crystal panel, wherein the driving circuit comprises a data driving circuit, a detector, a look-up table and a timing controller receiving a plurality of data signals, the look-up table storing a corresponding relationship among a plurality of electric signals corresponding to a plurality of environmental temperatures, a plurality of data signals and a plurality of control signals that are configured for driving the timing controller; the driving method comprising:

a. applying a data signal to the timing controller and the look-up table;

b. detecting a current environmental temperature using the detector, and outputting a corresponding electric signal;

c. looking up a corresponding control signal from the look-up table according to the corresponding electric signal and the data signal;

d. providing the corresponding control signal to the timing controller, the timing controller processing the data signal using a frame rate algorithm under control of the corresponding control signal, thereby outputting a desired data signal to the data driving circuit;

wherein a higher 6 bits binary datum of each data signal includes two numerical ranges stored in two different rows of a same column of the look-up table, the higher 6 bits binary datum in the first numerical range corresponds to the plurality of electric signals, each electric signal corresponds to four selecting signals, and each selecting signal corresponds to one of the plurality of control signals; and the higher 6 bits binary datum in the second numerical range merely corresponds to a specific control signal.

10. The driving method of claim 9, further comprising a step of the data driving circuit outputting a gray-level voltage to the liquid crystal panel according to the desired data signal.

11. The driving method of claim 9, wherein the input data signal is a 8-bit binary datum, the desired data signal is a 6-bit binary datum, and a lower 2 bits binary data of the input data signal forms a selecting signal.

12. The driving method of claim 11, wherein the higher 6 bits binary data of the plurality of data signals includes three numerical ranges stored in three different rows of a same column of the look-up table, the higher 6 bits binary data in the first numerical range correspond to the plurality of electric signals, each electric signal corresponds to four selecting signals, and each selecting signal corresponds to one of the plurality of control signals; and the higher 6 bits binary data in the second numerical range or the third numerical range correspond to four selecting signals, and the four selecting signals respectively correspond to four control signals.

13. The driving method of claim 12, wherein in step c, the corresponding control signal is acquired from the look-up table according to the higher 6 bits binary datum of the input data signal, the lower 2 bits binary datum of the input data signal and the corresponding electric signal.

14. The driving method of claim 9, wherein in step c, the corresponding control signal is acquired from the look-up table according to the higher 6 bits binary datum of the input data signal, the lower 2 bits binary datum of the input data signal and the corresponding electric signal.

15. The driving method of claim 9, wherein the timing controller comprises eight frame rate controllers, and in step d, when the corresponding control signal is applied to the timing controller, one of the eight frame rate controllers is selected according to the corresponding control signal, and processes the input data signal using the frame rate algorithm, thereby outputting the desired data signal to the data driving circuit.

* * * * *